United States Patent [19]

Jansen

[11] 4,205,560

[45] Jun. 3, 1980

[54] BAND PRESS

[75] Inventor: Johannes Jansen, Buchenhain, Fed. Rep. of Germany

[73] Assignee: Schloemann-Siemag AG, Düsseldorf, Fed. Rep. of Germany

[21] Appl. No.: 3,123

[22] Filed: Jan. 12, 1979

Related U.S. Application Data

[63] Continuation of Ser. No. 851,676, Nov. 15, 1977, abandoned.

[30] Foreign Application Priority Data

Nov. 11, 1976 [DE] Fed. Rep. of Germany ..... 2652307

[51] Int. Cl.[2] ..... B21B 39/16

[52] U.S. Cl. ..... 72/250

[58] Field of Search ..... 72/250, 252, 227; 74/29, 851, 676

[56] References Cited

U.S. PATENT DOCUMENTS

| | | | |
|---|---|---|---|
| 3,071,032 | 1/1963 | Teplitz | 72/250 |
| 3,406,553 | 10/1968 | Gross et al. | 72/252 |
| 3,665,771 | 5/1972 | Blatt | 74/29 |

*Primary Examiner*—Milton S. Mehr

*Attorney, Agent, or Firm*—Norman S. Blodgett; Gerrt A. Blodgett

[57] ABSTRACT

A band press for a moving sheet at the entry end of a rolling mill. The band press comprises upper and lower guide assemblies between which the sheet passes. Each assembly comprises a plurality of press plates which are adjustably mounted with respect to each other in a direction transverse to the direction of travel of the sheet to accommodate sheets of different widths. Means are provided for moving the outer press plates and rack and pinion drive means operatively connect the outer press plates to the remaining press plates.

3 Claims, 3 Drawing Figures

BAND PRESS

This is a continuation of application Ser. No. 851,676 filed Nov. 15, 1977, abandoned.

BACKGROUND OF THE INVENTION

Band presses shown, for instance, in U.S. Pat. No. 3,071,032. In this known embodiment of a band press, the press plates of one plane are connected with one another and with the outer press plates through a press plate adjusting means of the lazy-tong type, so that, on separation of the outer press plates, those provided between them are each traveling a path that is proportional to their median distance from the plane of symmetry of the band press. This positive guidance of the press ledges is, however, delicate and sensitive and the functional reliability can, therefore, be impaired under the conditions of grime and abrasion prevailing in the rough rolling mill operation.

For this reason, another type of band press has been proposed, as shown in DT-OS 21 12 753, in which the worm-gear spindles have threaded sections in the number of the border plates or press plates, respectively, that are to be moved within the press surface, and in which the border or press plates are equipped with spindle nuts that engage the threaded sections. The thread pitches on this known embodiment are proportional to the main distances of the associated border plates or press plates from the plane of symmetry, and the over-all diameters of the thread sections drop from the inside to the outside at least to the value of the pitch diameter of each preceding thread section; the known worm-gear spindles are connected via a vertical shaft through bevel gearings of which at least one bevel gear is able to slide axially on the vertical shaft by means of a multiple spline connection.

This known band press has the disadvantage that it requires the adjustment of the press plates within both planes to positively identical widths, whereby the press plates must participate in the movement in a manner always proportional to their mean distance from the plane of symmetry of the band press. This requires the installation of rather expensive worm-gear spindles with threads of variable pitch, which, on the one hand, are fairly costly to manufacture and, on the other hand, also require regular maintenance.

This is an object of the present invention to eliminate the disadvantages of the known embodiments of band presses and to create a band press of the initially mentioned kind that can be manufactured relatively simple, as well as in an economical manner, and which is, nevertheless, of rugged construction and, therefore, satisfactorily functionable in the rough rolling mill operation without expensive maintenance.

SUMMARY OF THE INVENTION

This task is solved in that there are provided toothed racks parallel to the worm-gear spindles that drive the outer press plates which mesh with pinions that effect one half of a lift stroke of these press plates on median press plates. In particular, the band press of the invention is so designed that the racks that are provided with teeth at one side, are firmly supported at one side between the outer press plate and their mounting strip and mesh at the other end with each one pinion that is loosely co-rotatingly journaled in the central press plate. With these pinions are also meshed the toothed racks that are similarly journaled at one side between central press plates and their mounting strips. Preferably, the symmetrically-journaled press plates are thereby movably constructed in that between the central press plates and their mounting strips are supported additional toothed racks that mesh with one each of the pinions that are loosely co-rotatingly journaled in the symmetrical intermediate press plate. In that way between the two pinions meshes the bilaterally toothed rack that is one-sidedly firmly journaled between the symmetrical outer press plate and its mounting strip.

The invention relates, therefore, to a band press for a sheet rolling mill with upper and lower press plates, disposed in respective plane above and below the sheet of the band and raisable from one another by groups, which are power-actuated via worm-gear spindles each with right and left thread sections and with thereon overlapping spindle nuts, and movable symmetrically to the vertical median plane of the band press, whereby mechanisms in the form of forced guides are provided for synchronization of the displacement motion of the upper and lower press plates and to their shifting proportionally to their distance from the vertical median plane of the band press.

The advantages of the band press constructed according to the invention can be seen especially in the fact that, in a simple and therefore, also in an economical manner, a ruggedly-constructed drive for the outer press plates of this band press can be manufactured that will satisfactorily function even in rough rolling mill operation and without expensive maintenance.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
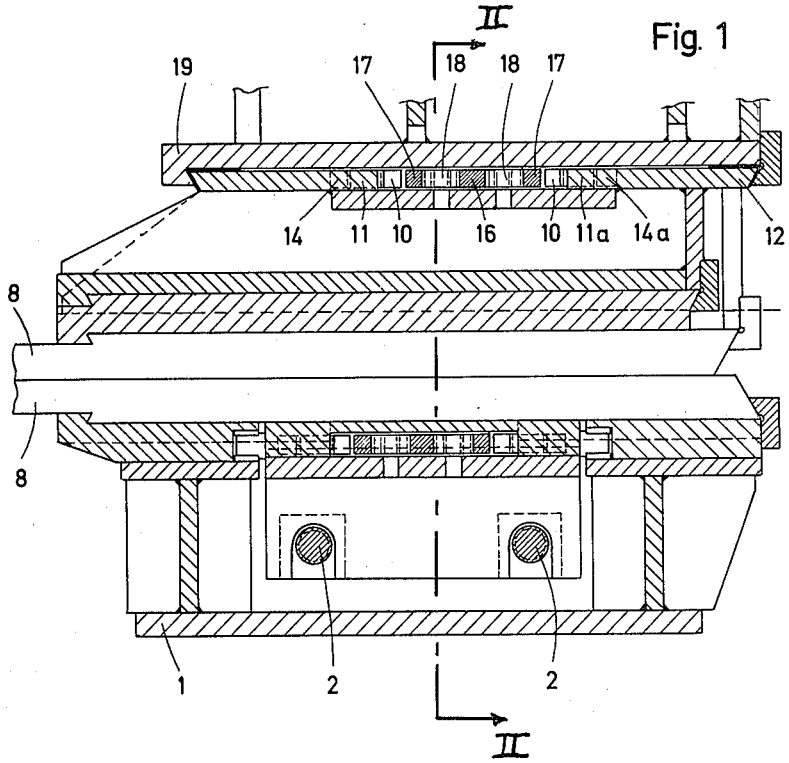
FIG. 1 is a side elevational view of the band press, partly sectioned.

In FIG. 1 is presented a frame 1 in which are journaled in side-by-side relationship two lower worm-gear spindles 2 located vertically of the direction of travel of the band and which can be driven in known manner through a common driving arrangement, not shown. According to FIG. 2, there is provided on the worm-gear spindle 2 a spindle nut 3 that is designed as an engaging member for an outer press plate 4 and the guide ledges 5 of the band press.

In the center of frame 1 are provided securely disposed press plates 6. Between the press ledges 4 and the press plates 6 are arranged at both sides (at identical distances from the center) intermediate press plates 7. The guide ledges 5 as well as also the press plates 6 and 7 are equipped with exchangable wearing pieces 8.

Figure 2:
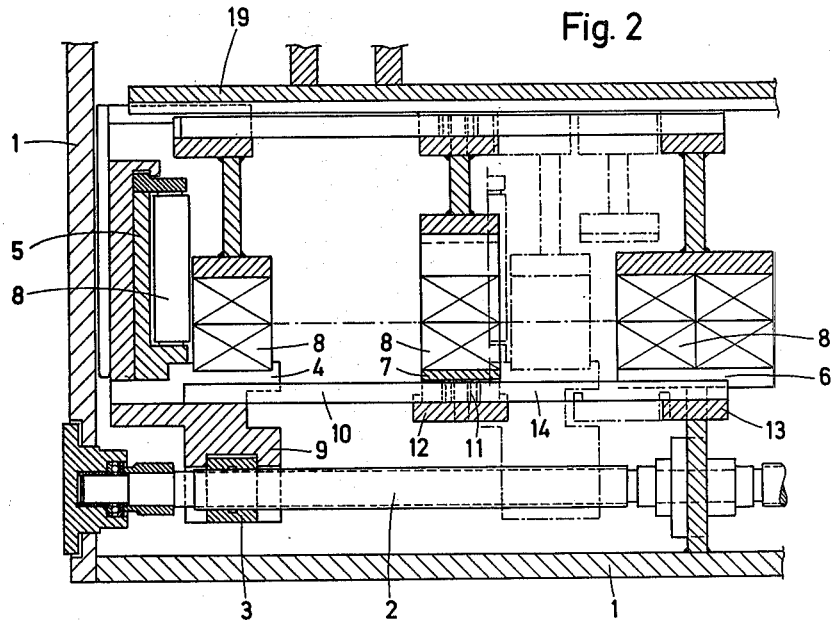
FIG. 2 is a partial sectional view taken along the line II—II in FIG. 1.

Between the outer press plate, shown in FIG. 2, and its mounting plate 9 is firmly journaled a toothed rack 10 equipped with teeth at one side that meshes with a pinion 11 that is loosely co-rotatingly journaled in the mounting plate 12 of the press brackets 7. In like manner another rack 14 is firmly arranged between the centrally disposed press plate 6 and its mounting brackets 13 and it likewise meshes with the pinion 11. When the worm-gear spindle 2 is driven, then the press plate 4 and the toothed rack 10 is also shifted with it from the position shown in FIG. 2 into the position shown in broken lines. Likewise, the intermediate press plate 7 is shifted by means of rack 10, pinion 11 and the other rack 14, but (compared to the outer press ledge) by only one-half of the distance, so that, in the end position (in which the band press displays the opening for the smallest possible band width of the material-to-be-rolled) the mounting brackets 9, 12, 13 and the press plates 4, 6, 7 fixed on the mounting bracket with the wearing pieces 8 lie side by side and form a guide plane.

Figure 3:
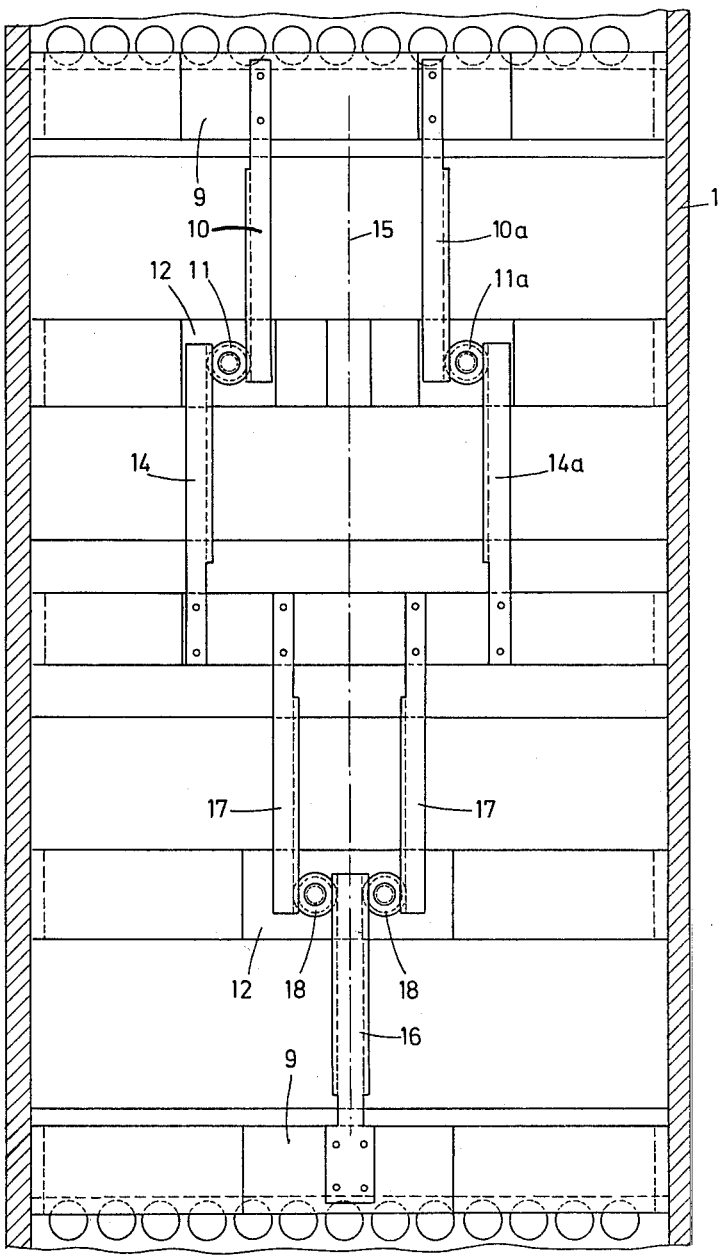
FIG. 3 is a plan view.

To avoid jamming of the toothed racks 10, 14, when the press plates are shifted, there are provided, as is evident in FIG. 3, toothed racks **10*a* and 14*a*, as well as a pinion 11*a***, in a mirror-inverted position relative to the imaginary plane of symmetry.

In the same way that the press plates 4 and 7, which are part of the band press illustrated in FIG. 2, are pushed together into a guide plane with the central press ledges 6, the part of the band press that is symmetrical to FIG. 2, as per FIG. 3, there is simultaneously pushed together by means of racks 16, 17, and pinions 18. However, the rack 16 is disposed between the outer press plate 4 and its mounting bracket 9 in the above-mentioned plane of symmetry and is provided at both sides with teeth that run between two pinions 18 in the central mounting bracket 12. The racks 17 are firmly disposed parallel to rack 16 and likewise meshing with the pinions 18 between the press plate 6 and its mounting bracket 13.

Just as the lower part of the band press is constructed in the maner described, so also is its upper part assembled, movably constructed, and capable of being pushed together by means of racks 10, 14, 16, 17, and pinions 11, 18 (cf. FIG. 1). The only difference, compared to the lower part, is the method of supporting the undepicted upper worm-gear spindles, which are journaled in a press frame 19 and connected and driven, for instance, through bevel gears with the lower worm-gear spindles 2.

It is obvious that minor changes may be made in the form and construction of the invention without departing from the material spirit thereof. It is not, however, desired to confine the invention to the exact form herein shown and described, but it is desired to include all such as properly come within the scope claimed.

I claim:

1. A band press for a moving sheet at the entry end of a rolling mill, the press having a stop guide assembly and a bottom guide assembly between which the sheet passes, at least one of said assemblies being movable in a transverse direction to the plane of the sheet, each assembly comprising:

(a) a plurality of press plates arranged in a plane parallel to the sheet and comprising two outer plates, a central plate disposed between the two outer plates, and at the central plate, the outer and intermediate plate being guided for movement in said plane transversely of the path of movement of the sheet and the central plate being fixed against movement in said plane, (b) drive means for moving the outer plates relative to the central plate, and (c) rack and pinion means anchored in the central plate and connected to the outer and intermediate plates at each side of the central plate so that the intermediate plates are moved in synchronism with the outer plates.

2. A band press as recited in claim 1, wherein the rack and pinion means at one side of the central plate comprise:

(a) first and second pinions rotatably journaled on the intermediate press plate, (b) first and second parallel outer racks connected to the outer plate and extending toward the intermediate press plate in mesh with the first and second pinions, respectively, and (c) first and second parallel inner racks connected to the central plate and extending toward the intermediate plate in mesh with the first and second pinions, respectively, each pinion being engaged by respective inner and outer racks at points 180° apart.

3. A band press as recited in claim 1, wherein the rack and pinion means at one side of the central plate comprise:

(a) first and second pinions rotatably journaled on the intermediate press plate, (b) first and second parallel inner racks connected to the central plate, an outer rack connected to the outer plate and extending between the first and second pinions and meshing with both pinions, and (c) first and second parallel inner racks conected to the central plate and extending toward the intermediate plate in mesh with the first and second pinions, respectively, at points diametrically opposed from the parts of engagement by the outer rack.

* * * * *